US005558526A

United States Patent [19]

Nagamine

[11] Patent Number: 5,558,526

[45] **Date of Patent: * Sep. 24, 1996**

[54] CONNECTOR WITH A CONTACT-ALIGNING DEVICE

[75] Inventor: Akira Nagamine, Kawasaki, Japan

[73] Assignee: The Whitaker Corporation, Wilmington, Del.

[ * ] Notice: The portion of the term of this patent subsequent to Mar. 29, 2014, has been disclaimed.

[21] Appl. No.: 390,597

[22] Filed: Feb. 17, 1995

Related U.S. Application Data

[63] Continuation-in-part of Ser. No. 219,597, Mar. 29, 1994, Pat. No. 5,501,606.

[30] Foreign Application Priority Data

Apr. 13, 1994 [JP] Japan ..... 6-074660

[51] Int. Cl.[6] ..... H01R 13/44

[52] U.S. Cl. ..... 439/140; 439/357

[58] Field of Search ..... 439/140, 141, 439/357, 358, 353, 350

[56] References Cited

U.S. PATENT DOCUMENTS 3,475,718 10/1969 Hartz et al. ..... 439/357 OR
4,684,192 8/1987 Long et al. ..... 439/350 X
5,380,217 1/1995 Yagi et al. ..... 439/358 OR
5,389,007 2/1995 Reinelt ..... 439/357 OR

FOREIGN PATENT DOCUMENTS 4-209479 7/1992 Japan .

*Primary Examiner*—P. Austin Bradley
*Assistant Examiner*—Daniel Wittels

[57] ABSTRACT

A connector with a contact-aligning device which can move in the direction of joining connectors and has locking devices which can move perpendicularly to the direction of the joining the connectors. The contact-aligning device has a contact-aligning plate with a number of through-holes corresponding to the number of male contacts and arms extending from the plate toward the back ends of the male contacts. The contact-aligning device can move from the position that is even with the ips of the male contacts to the position relative to the back ends thereof. The connector housing has side walls which have openings for locking devices which when inserted in the openings can assume a temporary-locked position or a fully-locked position. In the temporary-locked position, slanted surfaces on the arms of the contact-aligning device and on the locking devices engage each other and prevent movement of the contact-aligning device. When the locking devices are in the fully-locked position, the contact-aligning device can be moved when engaged by a mating connector. Also, the locking devices use retainers to lock the male contacts in position to prevent their withdrawal.

12 Claims, 9 Drawing Sheets

( PRIOR ART )

( PRIOR ART )

CONNECTOR WITH A CONTACT-ALIGNING DEVICE

CROSS REFERENCE TO ELATED APPLICATION

This application is a continuation-in-part of U.S. patent application Ser. No. 08/219,597, now U.S. Pat. No. 5,501,606 filed on Mar. 9, 1994.

FIELD OF THE INVENTION

This invention relates to connectors equipped with a contact-arraying device preventing male contacts from bending.

BACKGROUND OF THE INVENTION

Conventional connectors, as disclosed in Japanese Patent Publication 92-209479, are equipped with a contact-aligning device preventing male contacts arranged inside the connector housing from bending as shown in FIGS. 12–15.

As seen in FIGS. 12–15, the housing 12 of the female connector 10 has a number of male contacts 14. Tips 14*a* of these male contacts 14 pass via through-holes formed in a guide 16. Tips 16*b* of arms 16*a* of the guide 16 engage with lugs 12*a* made in the housing 12, thus preventing the guide 16 from being pulled out of the connector, and when the tips 16*b* are engaged with lugs 12*b*, the guide is secured temporarily. As shown in FIG. 15, at the initial stage of joining the female connector 10 with the male connector 20, the tips 16*b* of the guide 16 are pushed by the lug 20*a* formed on the male connector 20. When the male connector 20 is inserted further, the lug 20*a* snaps over the tip 16*b*. With a further advance of the male connector 20, the front end of the male connector 20 comes against the plate section 16*c* of the guide 16 and starts to push it inside. As a result, the tip 16*b* disengages from the lug 12*b* and the guide 16 moves toward the back ends of the male contacts 14. This accomplishes the joining of the female connector 10 and the male connector 20. In addition, the female connector 10 is equipped with a locking device 18 which fits on the housing 12 and locks the male contacts 14 in place.

From the above description, it follows that male contacts 14 are prevented from being bent due to the fact that their tips are inserted in the through-holes of the guide 16. When the female connector 10 and the male connector 20 are joined together, the guide 16 is pushed by the male connector 20 and it is moved to the back ends of the male contacts 14, but if the male connector is not inserted, the guide 16 is prevented from becoming loose by the engagement of the tips 16*b* with the lugs 12*a* in the housing 12. The engagement of the tips 16*b* with the lugs 12*b* provides for temporarily preventing the guide 16 from being moved back as a result of careless handling during transportation.

However, there is a danger that the guide can be moved to the back ends of the male contacts as a result of an accidental contact with a tool, another small connector or a bunch of wires in the harness assembly shop, and the device will not be able to perform its function of protecting male contacts from being bent. Another problem is that the guide is located in the cavity of the female connector, and when it is pushed to the back ends of the male contacts, it is very difficult to pull it back to its original position.

It is therefore the purpose of the present invention to prevent deformation of male contacts by offering a connector equipped with a contact-aligning device which is generally fail-safe with regard to undesirable movements of the contact-aligning device resulting from careless handling.

SUMMARY OF THE INVENTION

In order to achieve the purpose according to this invention, the contact-aligning device is reliably secured in a temporary- locked position by locking devices, which engage arms of the contact-aligning device to retain it in such a position, so that tips of the male contacts are inside through-holes of the contact-aligning device until the connector is joined with a mating connector. This makes it possible to prevent the contact-aligning device from being moved as a result of careless handling at the harness assembly shop or other locations. At the time of connection with another connector, the locking devices are shifted to the fully-locked position, thus allowing the contact-aligning device to move towards the rear end of the male contacts. As a result, the contact-aligning device is moved by the mating connector, thus making it possible to accomplish the joining of the connectors without bending the male contacts. When the locking devices are in the fully-locked position, they lock the male contacts in position to prevent their withdrawal.

BRIEF DESCRIPTION OF THE DRAWINGS

An embodiment of the invention will now be described by way of example with reference to the accompanying drawings, in which.

DETAILED DESCRIPTION OF THE INVENTION

Figure 1:
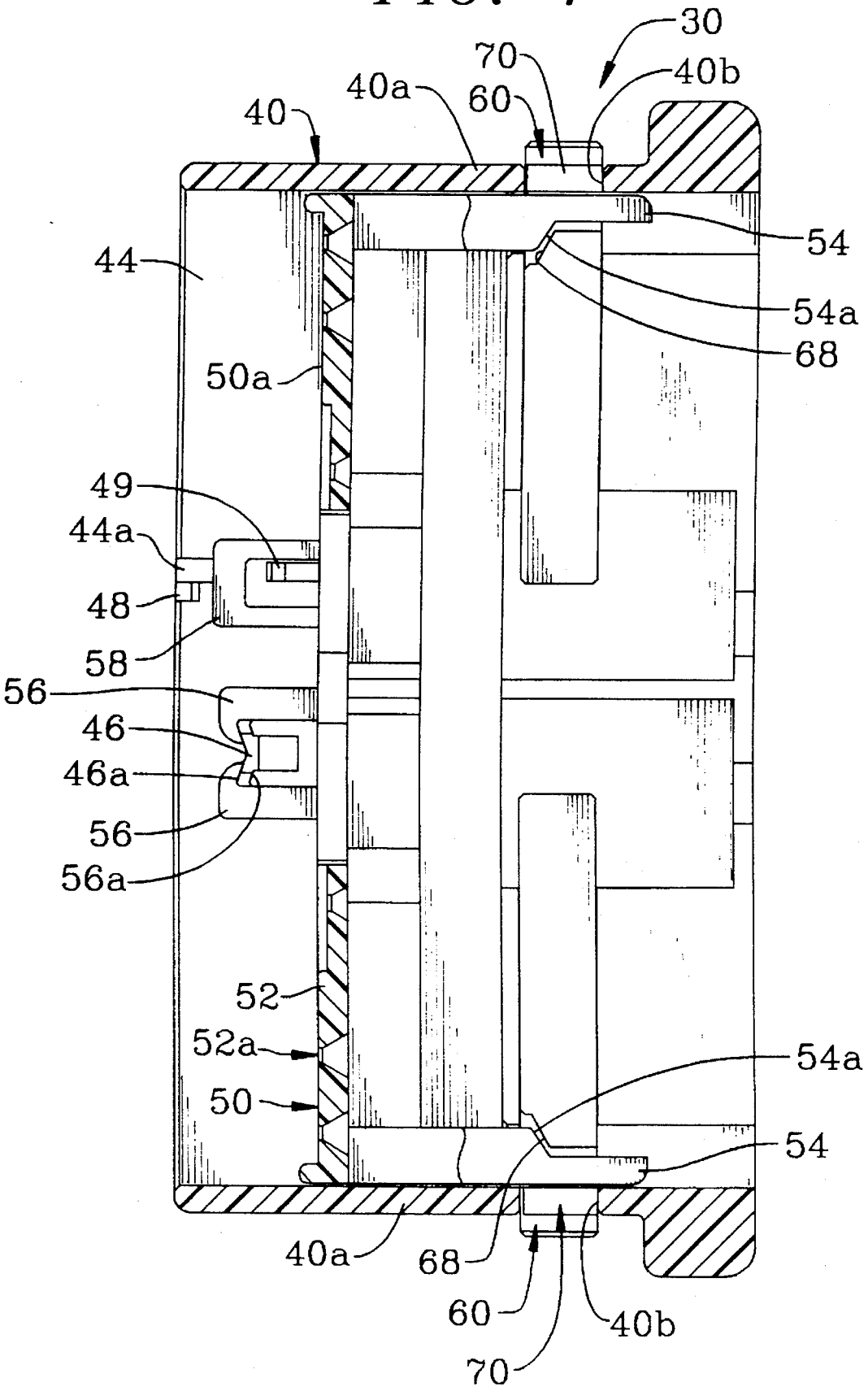
FIG. 1 is a partially sectioned view of a connector having a contact-aligning device in position where it is even with the tips of male contacts.
Figure 6:
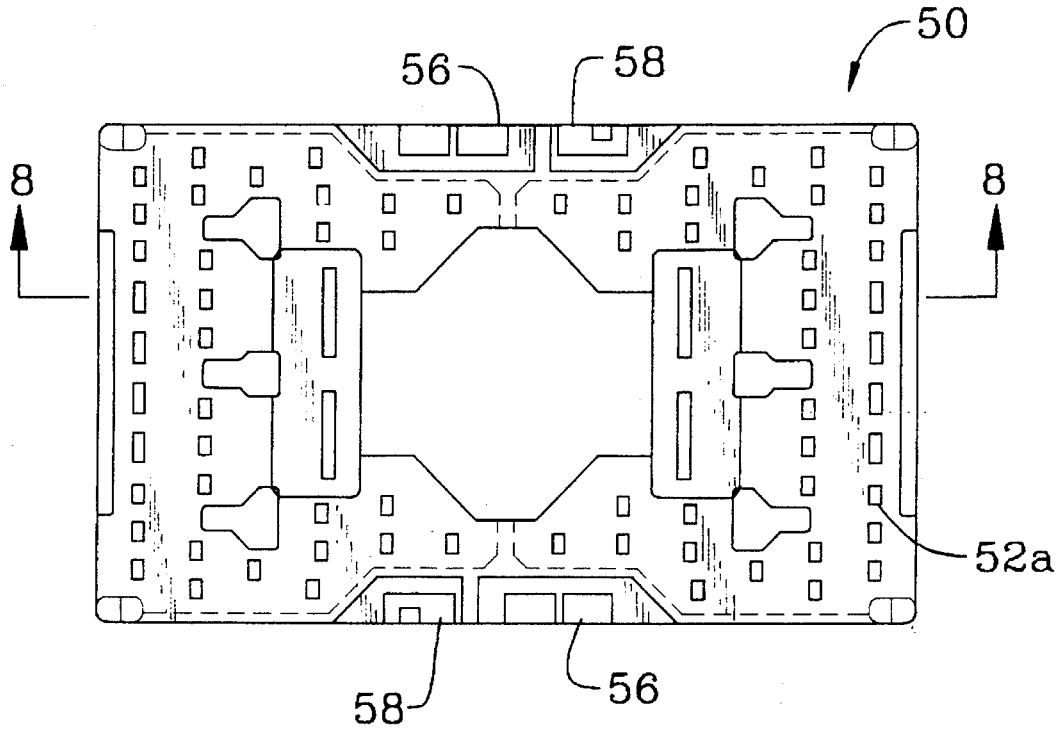
FIG. 6 is a front view of the contact-aligning device.
Figure 7:
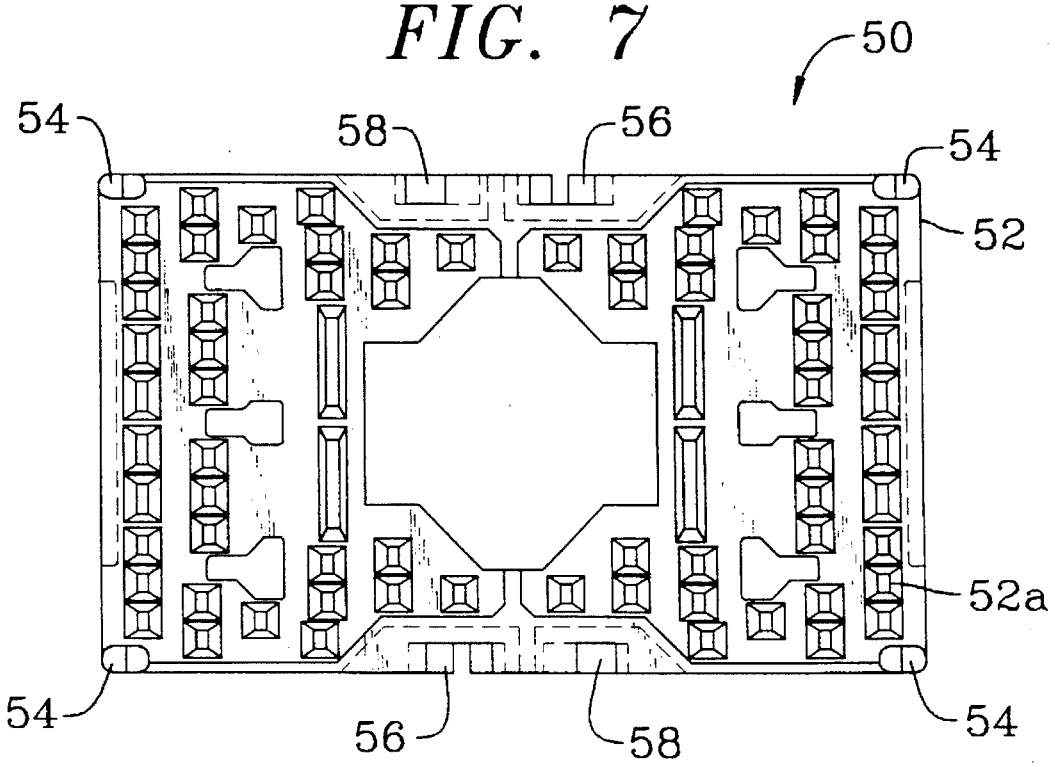
FIG. 7 is a rear view of the contact-aligning device.
Figure 8:
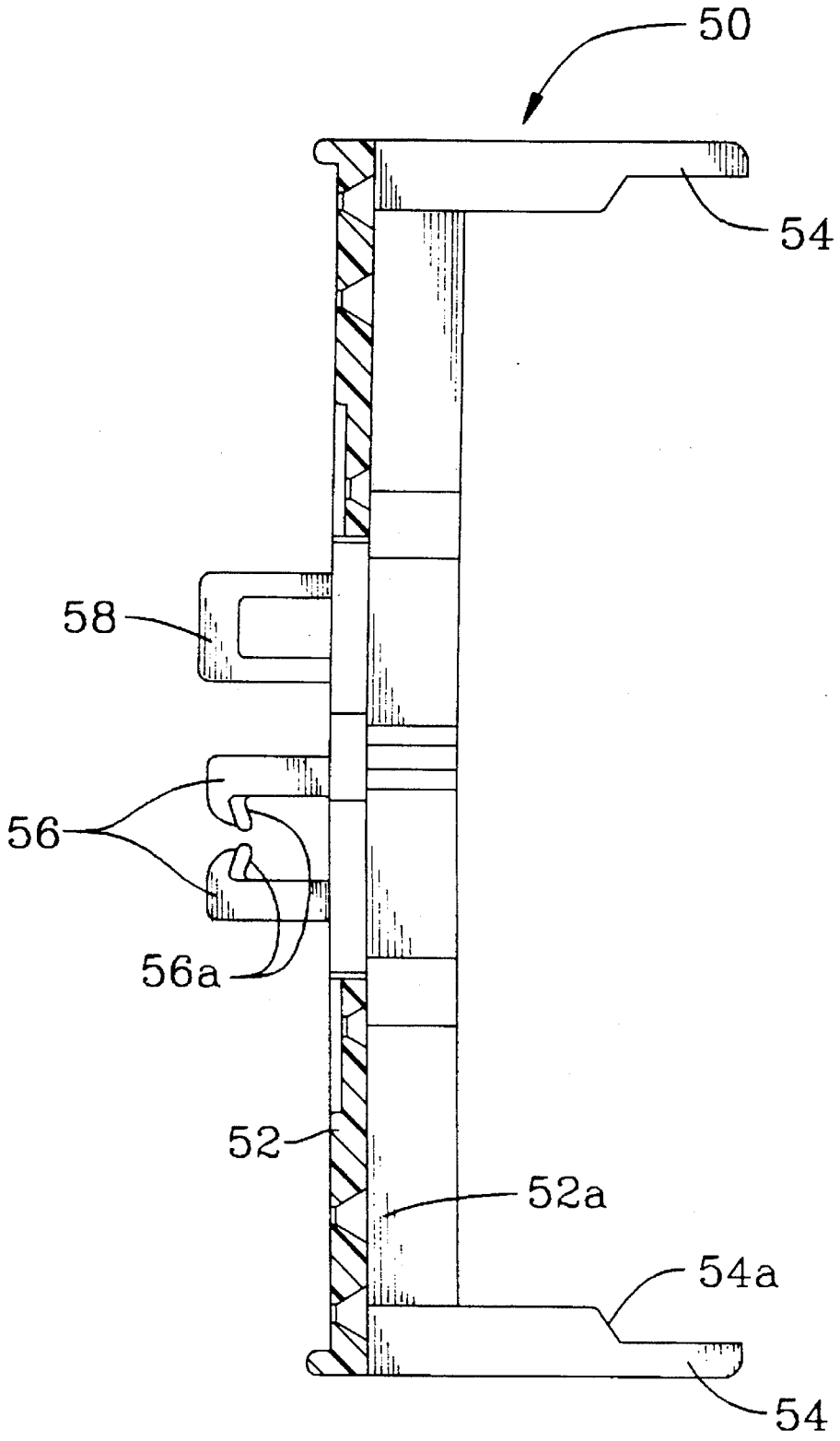
FIG. 8 is a cross-sectional view taken along 8—8 in FIG. 6.

FIG. 1 shows a connector 30 that comprises a female housing 40 having male contacts (not shown) arranged in it, a contact-aligning device 50 situated inside the female housing 40, and locking devices 60 which are inserted through locking device insertion openings 40*b* in the walls 40*a* of the female housing 40. The contact-aligning device 50 is provided to prevent male contacts from bending and it has a contact-aligning plate 2 in which a number of through-holes 52a correspond to the number of male contacts used in the connector, as also seen in FIGS. 6–7. Four arms 54, with one at each corner of the contact-aligning plate 52, are provided which extend in the direction toward the back end of the male contacts.

Figure 11:
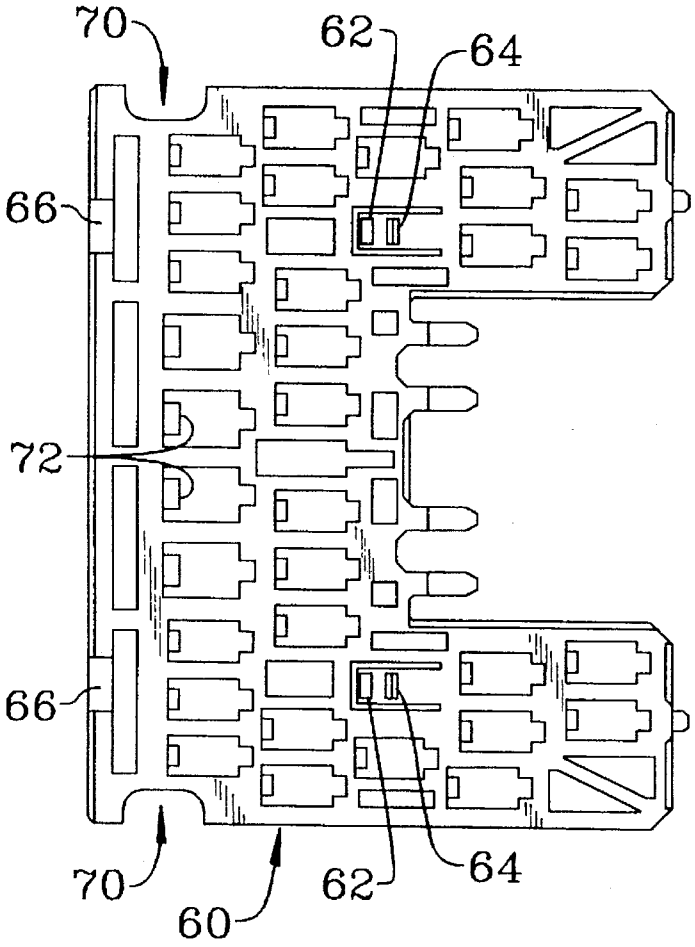
FIG. 11 is a back view of the locking device.
Figure 10:
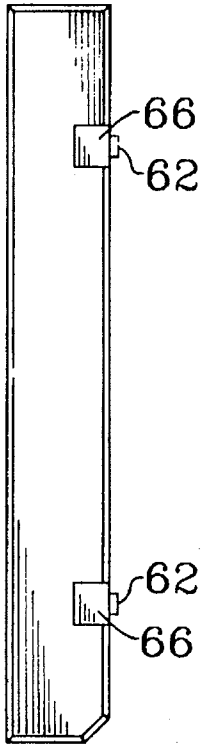
FIG. 10 is a side view of the locking device.
Figure 9:
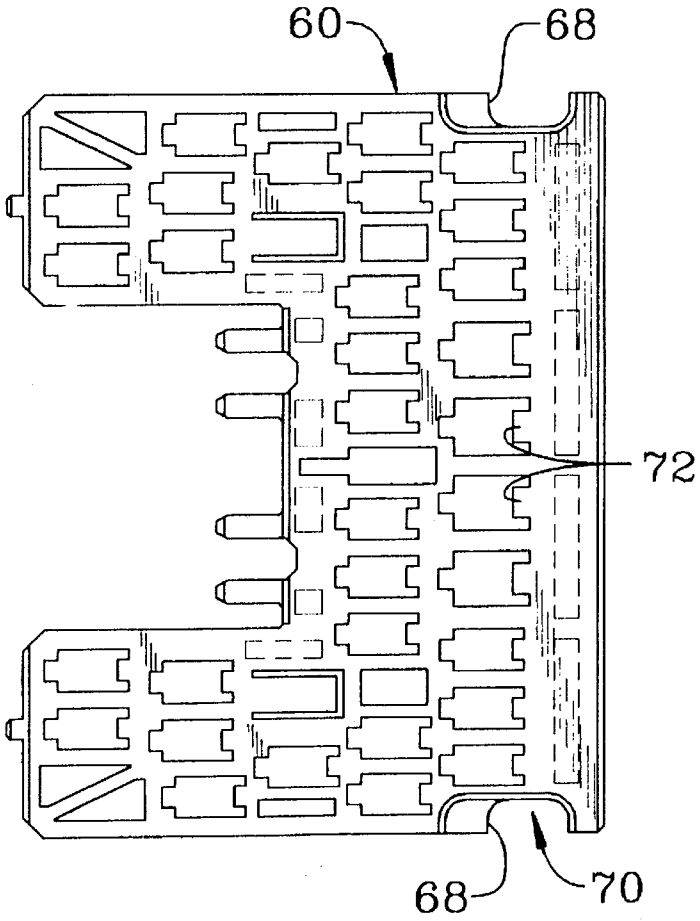
FIG. 9 is a front view of a locking device.
Figure 12:
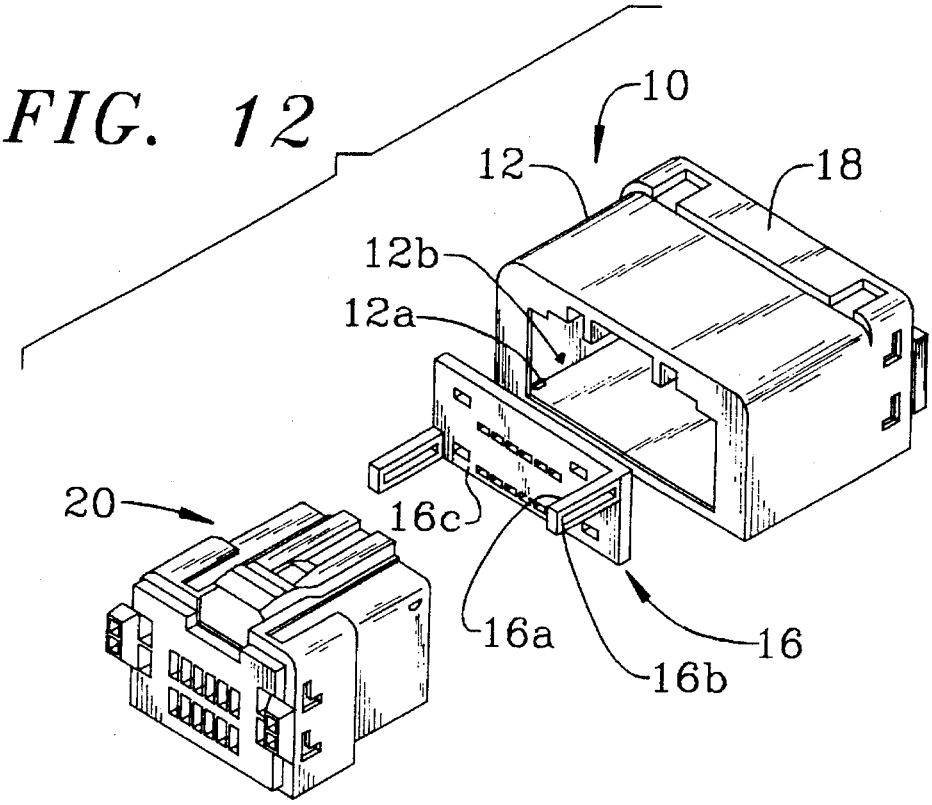
FIG. 12 is an exploded perspective view of a conventional female connector and a male connector before their joining.
Figure 13:
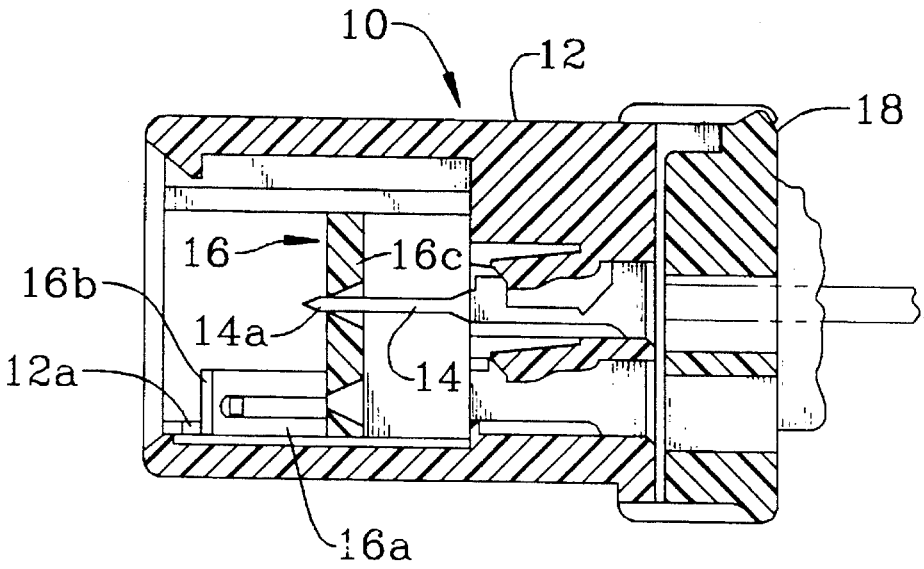
( PRIOR ART ) FIG. 13
FIG. 13 is a longitudinal cross-sectional view of the conventional female connector.
Figure 14:
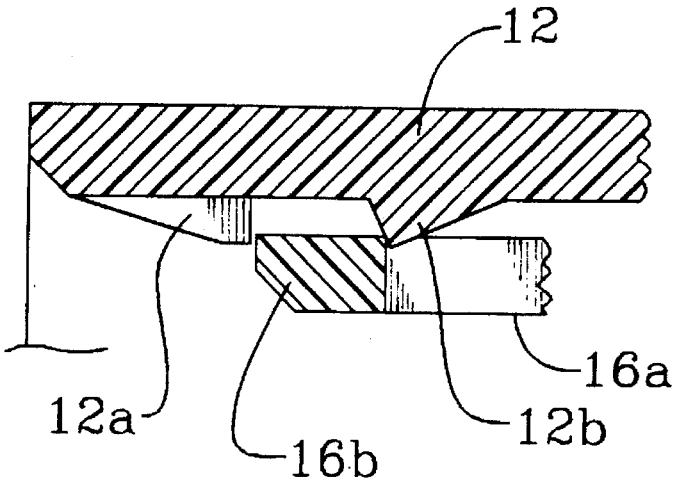
FIG. 14 is an enlarged partial cross-sectional view of the conventional female connector before connection with the male connector.
Figure 15:
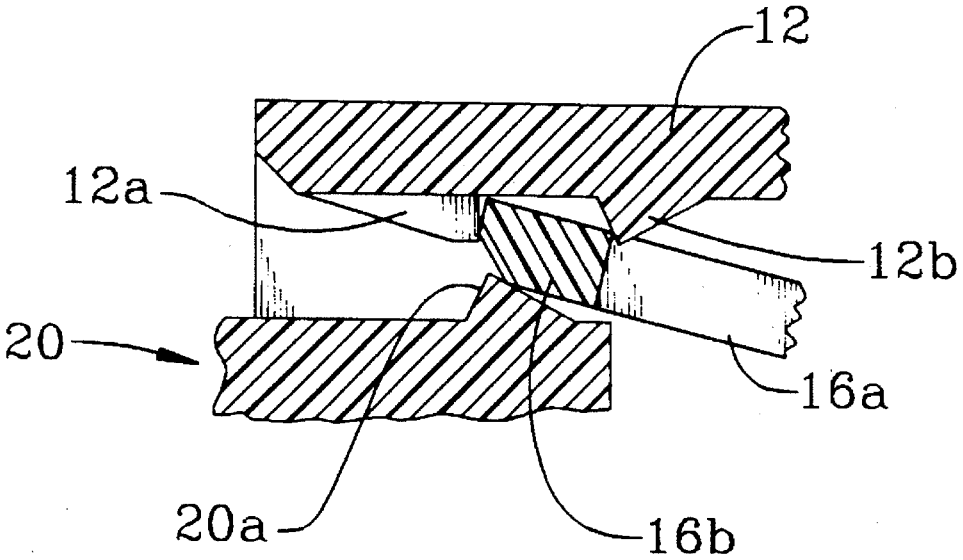
( PRIOR ART ) FIG. 15
FIG. 15 is an enlarged partial cross-sectional view of the conventional female connector in the process of connection with the male connector.

The purpose of the locking devices 60 is to lock the male contacts and engage the arms 54. They are inserted through the openings 40*b* provided in both walls 40*a* and have a number of through-holes that correspond to the through-holes of the contact-aligning device 50. The locking devices can move from a temporary-locked position (FIG. 1), where their lugs 62, 64 (FIGS. 10–11) are engaged with lugs provided on the female housing 40 (not shown) to a fully-locked position (FIG. 3) where lugs 62 snap over the lugs provided on the female housing 40 (not shown). The locking devices 60 can be removed from the female housing 40 by prying them out with a tool inserted in indentations 66 (FIG. 10).

The characteristic feature of the connector with a contact-aligning device according to this invention is that the contact-aligning device 50 is reliably protected from movement resulting from careless handling due to the engagement of the contact-aligning device 50 and the locking devices 60. When the locking devices 60 are in the temporary-locked position, indentations 54*a* of the arms 54 (FIG. 1) of the contact-aligning device 50 snap into indentations 68 of the locking devices 60 and reliably prevent the contact-aligning device 50 from being moved toward the back ends of the male contacts. When the locking devices 60 are in the fully-locked position (FIG. 3), the contact-aligning device 50 can be moved in the direction of the back ends of the male contacts because the arms 54 can pass through grooves 70 of the locking devices 60 and the male contacts are locked in place to prevent their withdrawal.

On wall 44 and its opposing wall of female housing 40 are protrusions 46 which provide surfaces 46*a*. Protrusions 46 engage with a corresponding pair of L-shaped legs 56 formed on the contact-aligning device 50 which have surfaces 56*a* (FIG. 1). This engagement of surfaces 46*a* and 56*a* prevents the contact-aligning device 50 from moving towards the back ends of the male contacts (not shown) as a result of vibration or other action. Protrusions 48 on the bottom wall 44 and its opposing wall of the female housing 40 engage corresponding locking legs 58 formed on the contact-aligning device 50 and prevent the contact-aligning device 50 from falling out of the female housing 40. In addition, there are protrusions 49 on the bottom wall 44 and its opposing wall of the female housing 40 which have two slanted surfaces running down from its center.

When a mating connector (not shown) is inserted in the female housing 40, the protrusions 49 engage their corresponding locking leg 58 and temporarily prevent the contact-aligning device 50 from moving until the housing of the mating connector engages the base surface 50*a* of the contact-aligning device 50. This prevents the male contacts (not shown) inside the female housing 40 from initially engaging with the female contacts (not shown) in the housing of the mating connector until they are completely aligned. Grooved 44*a* in the bottom wall 44 and its opposing wall of the female housing 40 are intended for the removal of the contact-aligning device 50 from the female housing 40 using a screwdriver or a similar tool. On the housing of the mating connector, a wedge-shaped protrusion is located for each corresponding pair of L-shaped legs 56 which enters in the gap between the L-shaped legs 56, thus releasing the engagement of the protrusions 46 and the L-shaped legs 56. This wedge-shaped protrusion at the same time engages the L-shaped legs 56 and stays engaged allowing the contact-aligning device to be pull back to the position that is even with the tips of the male contacts when the mating connectors are disconnected.

The condition depicted in FIG. 1 corresponds to the situation when the locking devices 60 are in the temporary-locked position in the female housing 40, the tips of the male contacts are in the through-holes 52*a* of the contact-aligning device 50 and no mating connector housing is inserted in the female housing 40. In this condition, the surfaces 46*a* of the protrusion 46 of the female housing 40 are in contact with the surfaces 56*a* of the L-shaped legs of the contact-aligning device 50, thus preventing undesirable movement of the contact-aligning device 50 toward the back ends of the male contacts. Since the tips of the male contacts are inside through-holes 52*a* of the contact-aligning device 50, they are safely protected from being bent by an external force or other interference.

Figure 2:
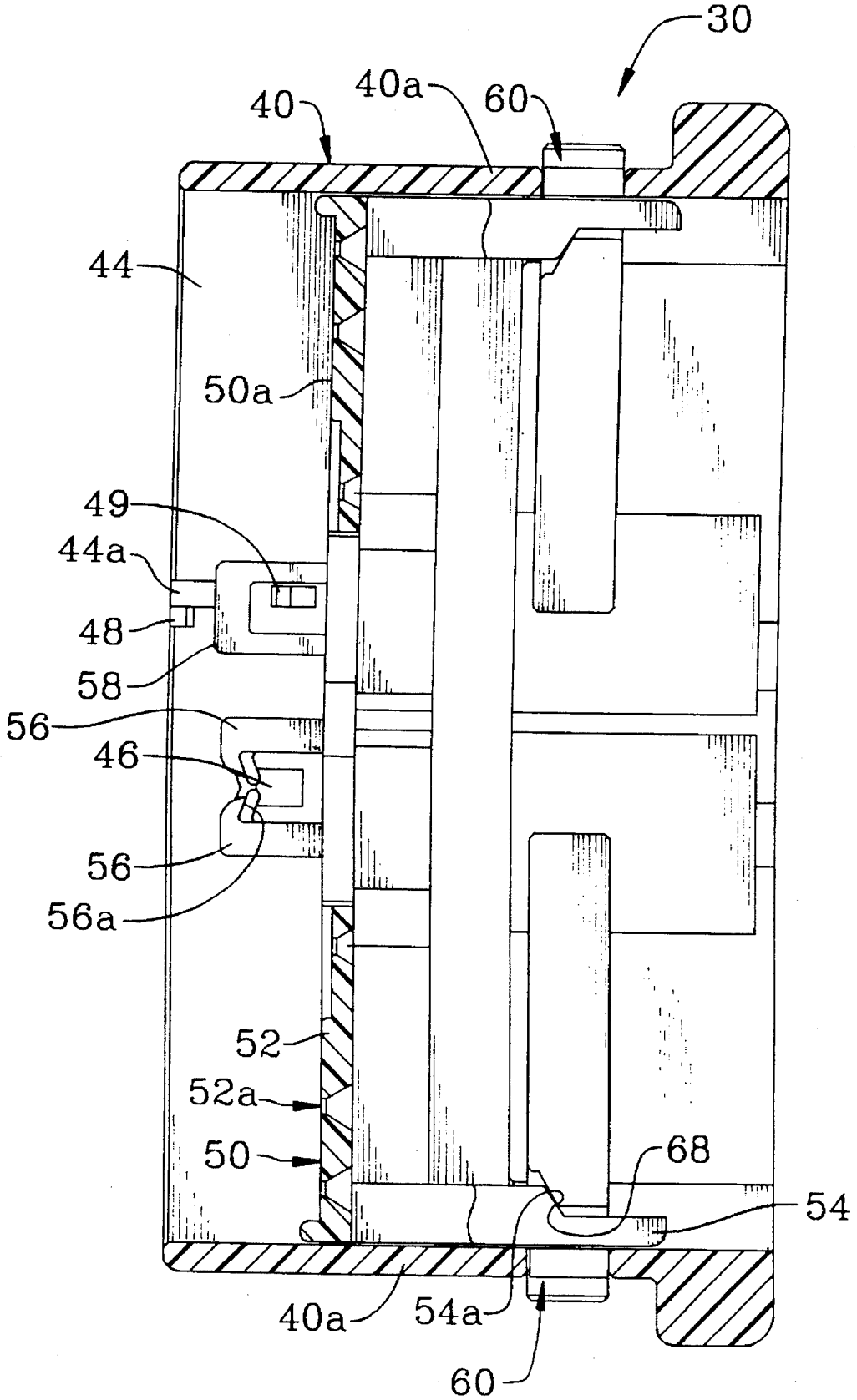
FIG. 2 is a view similar to FIG. 1 showing the contact-aligning device when an external force is applied to the device pushing it to the back of the connector.

The condition shown in FIG. 2 corresponds to the situation when pressure is applied against the contact-aligning device 50 and it comes in contact with the locking devices 60. In harness assembly shops, there is a constant danger that the contact-aligning device 50 will be strongly pushed inside by a tool, another small connector or by a bunch of wires. When the contact-aligning device 50 is strongly pushed, the L-shaped legs 56 snap over the protrusion 46 and the device starts to move toward the back ends of the male contacts and can not protect the male contacts from bending. However, when the locking devices 60 are in the temporary-locked position in the connector 30 with a contact-arraying device (FIG. 2), indentations 68 of the locking devices 60 snap into indentations 54*a* of the arms 54 of the contact-aligning device 50 and securely block the movement of the contact-aligning device 50 toward the back ends of the male contacts. This makes it possible to prevent undesirable movement of the contact-aligning device in the harness assembly shops even when it is strongly pushed, thus avoiding the bending of contacts.

Figure 3:
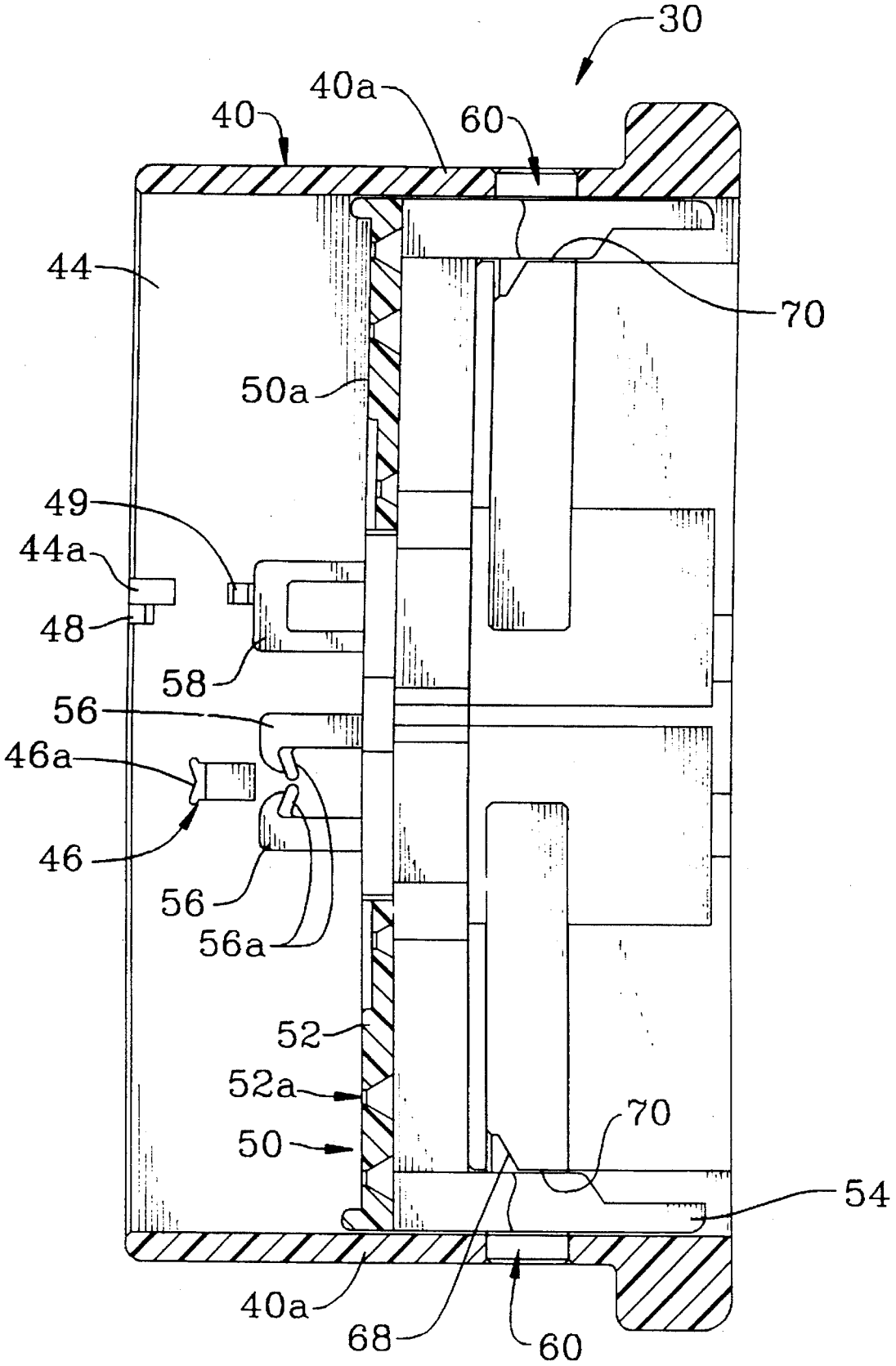
FIG. 3 is a view similar to FIGS. 1 and 2 showing the contact-aligning device when the connector is in a fully-connected position with a mating connector.
Figure 4:
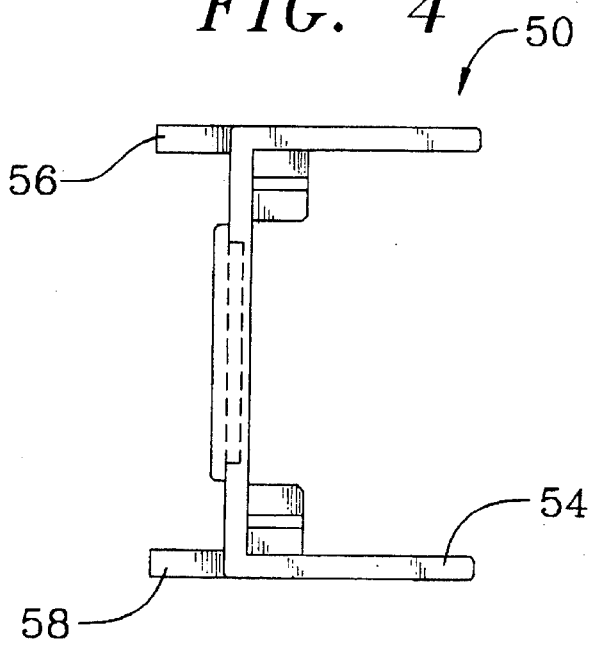
FIG. 4 is a side view of the contact-aligning device.
Figure 5:
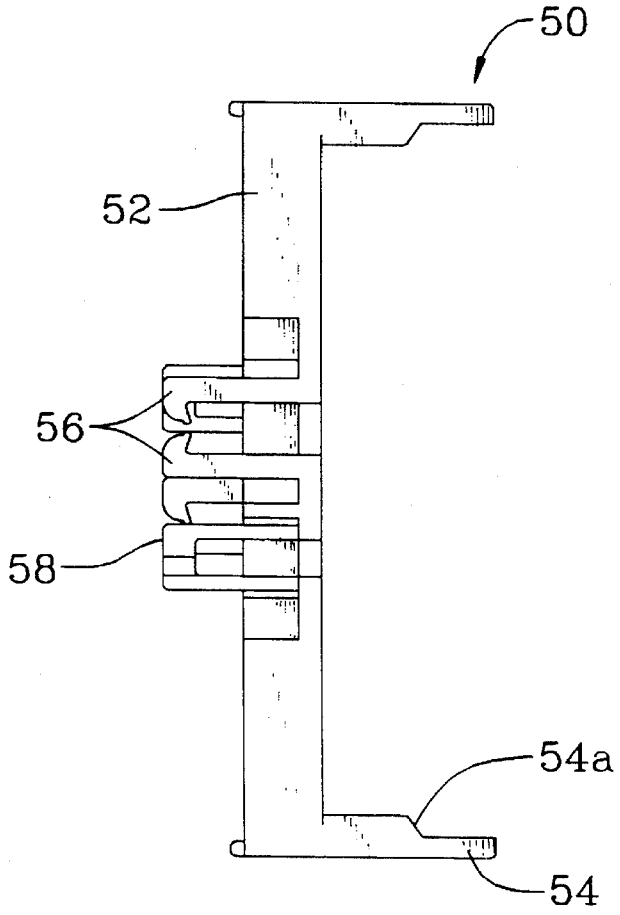
FIG. 5 is a top view of the contact-aligning device.

The condition depicted in the FIG. 3 corresponds to the situation when the locking devices 60 are in a fully-locked position. In this position, male contacts are engaged by contact retainers 72 (FIG. 7) and prevent withdrawal of the contacts. In addition, since the arms 54 now can pass through the grooves 70 of the locking devices 60, the contact-aligning device 50 can be moved to the back ends of the male contacts under pressure from a mating connector. In this position, since the locking devices 60 are blocked from removal by the arms 54, they are secured from falling out after the connector is joined with the mating connector.

In the embodiment described above, the indentations 54*a* of the arms 54 and the indentations 68 of the locking devices 60 have slanted sides, however they may be made straight in the direction perpendicular to the direction of the joining of the connectors.

As follows from the above explanations, the contact-aligning device of the connector according to this invention is reliably protected from being moved toward the back ends of the male contacts when the locking devices are in the temporary-locked position due to the fact that the locking devices are in contact with the arms of the contact-aligning device.

I claim:

1. A connector comprising a first connector including a first housing for receiving male contacts that extend in a mating direction of said first connector, said first connector adapted to receive a second connector including a second housing to mate with said first housing, and a contact-aligning device in said first housing having a contact-aligning plate with a number of through-holes through which contact sections of male contacts pass and is movable toward rear ends of the contact sections when pushed by the second housing as the first and second connectors are mated together, characterized by:

a locking device used to prevent movement of said contact-aligning device;

said first housing having a pair of side walls with an opening in one of the sidewalls for the insertion of the locking device;

said contact-aligning device having a set of arms extending from said contact-aligning plate that engages said locking device;

said first housing having a protrusion formed on an inner wall thereof at a position in front of the male contact sections;

said contact-aligning device having a pair of legs in a form of resilient spring members extending in the mating direction and including a pair of hook members engaging said protrusion to prevent movement of said contact-aligning device towards the rear of male contact sections; and said pair of legs being engagable with a pushing protrusion of the second housing by pushing said hook members free of said first housing protrusion during mating between the first and second housings thereby permitting said contact-aligning device to move towards the rear of the male contact sections.

2. A connector as claimed in claim 1, wherein said locking device is located at:

a temporary-locked position that prevents movement of said contact-aligning device in the direction of the back end of the male contacts by the engagement of said locking device and said arms; and is moved to a fully-locked position which disengages said locking device and said arms which allows said contact-aligning device to move in the direction of the back end of the male contacts.

3. A connector as claimed in claim 2, wherein said locking device has a number of other through-holes that correspond to said through-holes of the contact-aligning plate which lock the male contacts into position when said locking device is at the fully-locked position.

4. A connector as claimed in claim 3, wherein said other through-holes have a retainer type protrusion in each hole that retains the male contacts in position.

5. A connector as claimed in claim 3, wherein said locking device and said first housing have lugs that engage each other that prevents the locking device from being removed from said first housing or pushed into said fully-locked position accidentally while in said temporary-locked position.

6. A connector as claimed in claim 3, wherein said locking device has a removal means that aids in the removal of the locking device from the opening.

7. A connector as claimed in claim 6, wherein said removal means has at least one indentation in said locking device that aids removal when using a tool.

8. A connector as claimed in claim 1, wherein said first housing has another protrusion on an opposing wall of said inner wall, and said contact-aligning device has another pair of legs including hook members that engage said protrusion on said opposing wall.

9. A connector as claimed in claim 1, wherein another locking device is provided and another opening in the opposing sidewall of the first housing is provided for insertion of said another locking device.

10. A connector as claimed in claim 1, wherein a restraining protrusion is located on said inner wall and a corresponding locking leg on said contact-aligning device, whereby said restraining protrusion restrains said locking leg and thereby said contact-aligning device from moving towards the end of the male contacts.

11. A connector as claimed in claim 10, wherein a stop-type protrusion is located on said inner wall that engages said locking leg and prevents the removal of said contact-aligning device from the first housing.

12. A connector as claimed in claim 11, wherein a groove is located in said inner wall that aids in lifting said locking leg over said stop-type protrusion when using a tool for the removal of contact-aligning device.

* * * * *